US008845062B2

(12) United States Patent
Shimosato et al.

(10) Patent No.: US 8,845,062 B2
(45) Date of Patent: Sep. 30, 2014

(54) DENSITY CORRECTION SYSTEM

(75) Inventors: Masashi Shimosato, Izunokuni (JP); Noboru Nitta, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 1430 days.

(21) Appl. No.: 12/536,676

(22) Filed: Aug. 6, 2009

(65) Prior Publication Data

US 2010/0039469 A1 Feb. 18, 2010

Related U.S. Application Data

(60) Provisional application No. 61/088,096, filed on Aug. 12, 2008.

(51) Int. Cl.
*B41J 2/205* (2006.01)
*B41J 2/21* (2006.01)
*B41J 29/38* (2006.01)

(52) U.S. Cl.
CPC ..... *B41J 29/38* (2013.01); *B41J 2/2128* (2013.01)
USPC ..... 347/15; 347/9; 347/19

(58) Field of Classification Search
CPC ..... B41J 2/2128; B41J 2/2125; B41J 2/2121; B41J 2/205; B41J 2/2052; B41J 2/2054
See application file for complete search history.

(56) References Cited

U.S. PATENT DOCUMENTS

| | | | | |
|---|---|---|---|---|
| 4,714,964 | A | 12/1987 | Sasaki | |
| 5,997,123 | A * | 12/1999 | Takekoshi et al. | 347/14 |
| 7,530,655 | B2 | 5/2009 | Yamanobe | |
| 2006/0017757 | A1 | 1/2006 | Goto | |
| 2007/0052996 | A1 * | 3/2007 | Ota | 358/1.15 |
| 2007/0132798 | A1 | 6/2007 | Bansyo | |
| 2007/0206041 | A1 | 9/2007 | Yamanobe | |
| 2007/0236739 | A1 * | 10/2007 | Murakami et al. | 358/3.06 |

FOREIGN PATENT DOCUMENTS

| | | |
|---|---|---|
| JP | 61-025365 | 2/1986 |
| JP | 06-255132 | 9/1994 |
| JP | 09-070989 | 3/1997 |
| JP | 10-329317 | 12/1998 |
| JP | 2000-127376 | 5/2000 |
| JP | 2002-211011 | 7/2002 |

(Continued)

OTHER PUBLICATIONS

Japanese Office Action for Japanese Application No. 2009-185917 mailed on May 29, 2012.

(Continued)

*Primary Examiner* — Justin Seo

(74) *Attorney, Agent, or Firm* — Amin, Turocy & Watson, LLP

(57) ABSTRACT

A density correction system includes a conveyance unit that conveys a recording medium, a first ink ejection unit that ejects ink in a multi-drop driving system to the recording medium based on image data, a second ink ejection unit that ejects ink in the multi-drop driving system to the recording medium based on the image data and in which a volume per one drop is smaller than that of the first ink ejection unit, and a control unit that corrects number of drops from the first ink ejection unit and number of drops from the second ink ejection unit, which constitute a droplet amount for one pixel on the recording medium subjected to image formation.

17 Claims, 4 Drawing Sheets

(56) References Cited

FOREIGN PATENT DOCUMENTS

| | | |
|---|---|---|
| JP | 2002-316414 | 10/2002 |
| JP | 2003-170588 | 6/2003 |
| JP | 2004-9548 | 1/2004 |
| JP | 2006-150257 | 6/2006 |
| JP | 2007-237399 | 9/2007 |

OTHER PUBLICATIONS

Japanese Office Action for Japanese Patent Application No. 2013-111259 mailed on May 7, 2014.

* cited by examiner

| A line | | B line | | Dot volume |
|---|---|---|---|---|
| Volume/drop | Maxdrop number | Volume/drop | Maxdrop number | |
| 6.5 | 0 | 5.5 | 7 | 38.5 |
| 6.5 | 1 | 5.5 | 6 | 39.5 |
| 6.5 | 2 | 5.5 | 5 | 40.5 |
| 6.5 | 3 | 5.5 | 4 | 41.5 |
| 6.5 | 4 | 5.5 | 3 | 42.5 |
| 6.5 | 5 | 5.5 | 2 | 43.5 |
| 6.5 | 6 | 5.5 | 1 | 44.5 |
| 6.5 | 7 | 5.5 | 0 | 45.5 |

FIG. 3

| A line | | B line | | Dot volume |
|---|---|---|---|---|
| Volume/drop | Maxdrop number | Volume/drop | Maxdrop number | |
| 6.25 | 0 | 5.75 | 7 | 40.25 |
| 6.25 | 1 | 5.75 | 6 | 40.75 |
| 6.25 | 2 | 5.75 | 5 | 41.25 |
| 6.25 | 3 | 5.75 | 4 | 41.75 |
| 6.25 | 4 | 5.75 | 3 | 42.25 |
| 6.25 | 5 | 5.75 | 2 | 42.75 |
| 6.25 | 6 | 5.75 | 1 | 43.25 |
| 6.25 | 7 | 5.75 | 0 | 43.75 |

FIG. 4

DENSITY CORRECTION SYSTEM

CROSS-REFERENCE TO RELATED APPLICATION

This application claims the benefit of U.S. Provisional Application No. 61/088,096, filed Aug. 12, 2008.

TECHNICAL FIELD

The present invention relates to a density correction system to correct a droplet amount per one pixel from an inkjet head.

BACKGROUND

Hitherto, a droplet amount ejected from a nozzle of an inkjet head used in an inkjet recording apparatus has a variation of ±5 to 10% for each nozzle. Inkjet heads are different from each other in the shape accuracy of nozzles and pressure chambers, and the characteristic accuracy of piezoelectric material and the like.

The variation becomes a density variation of a printed material. Especially, when an inkjet technique is used for printing of a color filter or the like of a liquid crystal display, the accuracy of the inkjet technique dominates the performance of a product.

Hitherto, in an inkjet head having plural nozzles, in order to reduce variation in droplet amounts from the respective nozzles, a method is used in which a drive waveform is changed for each of the nozzles.

However, in order to use this method for the inkjet recording apparatus, a drive circuit is required for each of the nozzles. Thus, the drive circuit to drive the whole inkjet head becomes large and expensive.

The invention provides a density correction system capable of reducing variation in droplet amount per one pixel.

SUMMARY

According to one aspect of the present invention, there is provided a density correction system comprising: a conveyance unit that conveys a recording medium, a first ink ejection unit that ejects ink in a multi-drop driving system to the recording medium based on image data, a second ink ejection unit that ejects ink in the multi-drop driving system to the recording medium based on the image data and in which a volume per one drop is smaller than that of the first ink ejection unit, and a control unit that corrects number of drops from the first ink ejection unit and number of drops from the second ink ejection unit, which constitute a droplet amount for one pixel on the recording medium subjected to image formation.

DESCRIPTION OF THE DRAWINGS

FIG. 3 is a table showing a relation between the number of drops from the inkjet head A and the inkjet head B of the embodiment and a total droplet amount for one pixel.

FIG. 4 is a table showing another example of a relation between the number of drops from the inkjet head A and the inkjet head B of the embodiment and the total droplet amount for one pixel.

DETAILED DESCRIPTION

Hereinafter, embodiments will be described with reference to the drawings.

Figure 1:
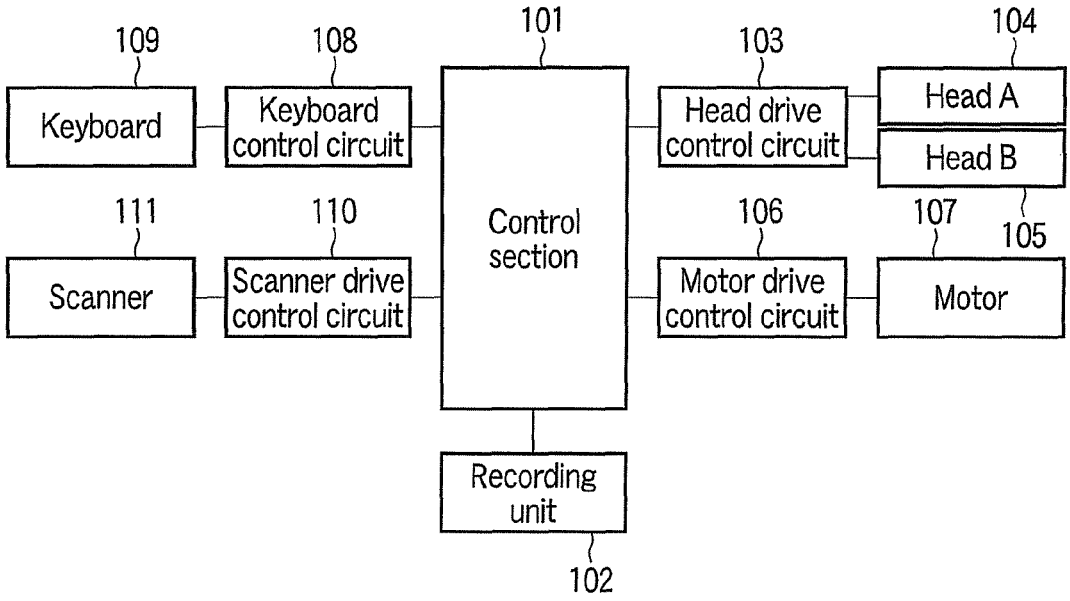
FIG. 1 is a block diagram of a density correction system of an embodiment.

FIG. 1 is a block diagram showing a density correction system of an embodiment. The density correction system includes a control unit 101, a recording unit 102, a head drive control circuit 103, an inkjet head A 104, an inkjet head B 105, a motor drive control circuit 106, a motor 107, a keyboard control circuit 108, a keyboard 109, a scanner drive control circuit 110, and a scanner 111.

For example, the control unit 101, the recording unit 102, the head drive control circuit 103, the inkjet head A 104, the inkjet head B 105, the motor drive control circuit 106, and the motor 107 constitute an inkjet recording apparatus. The keyboard 109 (which is controlled by the keyboard control circuit 108), and the scanner 111 (which is controlled by the scanner drive control circuit 110) are external equipments connected to the inkjet recording apparatus.

The control unit 101 controls the operations of the respective units of the density correction system. The recording unit 102 records various data of operation programs and the like. The head drive control circuit 103 controls the driving of the inkjet head A 104 and the inkjet head B 105. For example, the head drive control circuit 103 controls the number of drops of ink ejected from the inkjet head A 104 and the inkjet head B 105. The motor drive control circuit 106 controls the driving of the motor 107. The motor 107 is a conveyance unit to convey a recording medium according to the driving.

The keyboard control circuit 108 transmits an input signal to the control unit 901 based on input from the keyboard 109. The keyboard 109 is an input unit used for inputting image data or inputting operation instructions to the respective units of the density correction system. The scanner drive control circuit 110 causes the scanner 111 to perform image reading and image processing.

Figure 2:
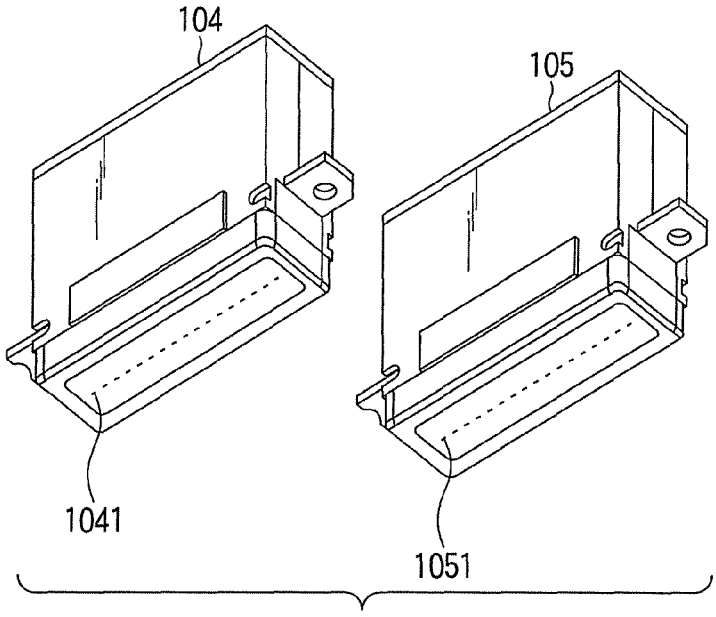
FIG. 2 is a perspective view of an inkjet head A and an inkjet head B of the embodiment.

FIG. 2 is a perspective view of the inkjet head A 104 and the inkjet head B 105. In the inkjet head A 104, nozzles 1041 to eject ink are arranged at a specified pitch in the width direction of the recording medium. That is, the inkjet head A 104 is a line-type print head in which the plural nozzles 1041 are arranged on a line. The same applies to the inkjet head B 105. In the inkjet head B 105, plural nozzles 1051 are arranged at the same pitch as the pitch of the nozzles 1041 arranged in the inkjet head A 104. The arrangement direction of the nozzles 1041 is a direction orthogonal to the conveyance direction of the recording medium. The same applies to the arrangement direction of the nozzles 1051. The inkjet head A 104 is provided upstream of the inkjet head A105 in the conveyance direction of the recording medium. The plural nozzles 1041 arranged in the inkjet head A 104 and the plural nozzles 1051 arranged in the inkjet head B 105 are opposite to each other in the conveyance direction of the recording medium.

In this embodiment, one pixel contains a droplet amount obtained by adding a droplet amount of ink ejected by the inkjet head A 104 to a droplet amount of ink ejected by the inkjet head B 105. Here, the added droplet amount is called a total droplet amount.

The inkjet head A 104 and the inkjet head B 105 perform a recording operation on a recording medium based on inputted image data. The inkjet head A 104 is an ink ejection unit of a multi-drop driving system in which a pixel diameter is changed by changing the number of ink droplets jetted to almost the same place of a recording medium, while the size of the ink droplet ejected from the nozzle 1041 is not changed. The same applies to the inkjet head B 105.

Here, the inkjet head A 104 is a head of a multi-drop driving system in which a volume per one drop of ink ejected from each of the nozzles 1041 is X pl on average. The inkjet head B 105 is a head of a multi-drop driving system in which a volume per one drop of ink ejected from each of the nozzles 1051 is Y pl on average.

Next, the number of drops from the inkjet head A 104 and the inkjet head B 105 and the total droplet amount for one pixel will be described. FIG. 3 is a table showing a relation between the number of drops from each of the inkjet head A 104 and the inkjet head B 105 and the total droplet amount for one pixel.

As a comparative example, a droplet amount based on only an inkjet head in which a volume per one drop is 6 pl on average will be described. Here, the standard droplet amount for a specific pixel is made to 6 pl×7 drops=42 pl. When a volume per one drop from the inkjet head fluctuates by 10% by a design error of a nozzle, the droplet amount for the specific pixel is 42 pl±2.1 pl. In other words, the droplet amount for the specific pixel is 42 pl±4.9%.

A volume per one drop of ink ejected from each of the nozzles 1041 arranged in the inkjet head A 104 of the embodiment is made to 6.5 pl on average. A volume per one drop of ink ejected from each of the nozzles 1051 arranged in the inkjet head B 105 is made to 5.5 pl on average. That is, the inkjet head A 104 is set to eject ink whose volume per one drop is 6.5 pl on average larger than that of the comparative example by 0.5 pl. The inkjet head B105 is set to eject ink whose volume per one drop is 5.5 pl on average smaller than that of the comparative example by 0.5 pl.

FIG. 3 shows the total droplet amount for one pixel when the number of drops from the inkjet head A 104 is changed from 0 to 7 and the number of drops from the inkjet head B 105 is changed from 7 to 0. The sum of the number of drops from the inkjet head A 104 and the number of drops from the inkjet head B 105 for one pixel is 7 and is constant. Here, there can be a case where the volume per one drop from the inkjet head A 104 and the inkjet head B 105 remarkably fluctuates by the influence of design error of the nozzle 1041 and the nozzle 1051. In this case, when the required total droplet amount is obtained, the sum of the number of drops from the inkjet head A 104 and the number of drops from the inkjet head B 105 for one pixel may not be 7 and may not be constant.

As shown in FIG. 3, in this embodiment, the combination of the numbers of drops from the inkjet head A 104 and the inkjet head B 105, which are different from each other in the volume per one drop, is changed. Similarly to the fact that the volume difference per one drop between the inkjet head A 104 and the inkjet head B 105 is 1 pl, the total droplet amount for one specific pixel is also changed in increments of 1 pl.

Here, similarly to the comparative example, when the volume per one drop from the inkjet head A 104 and the inkjet head B 105 fluctuates by 10% by the influence of design error of the nozzle 1041 and the nozzle 1051, the increment in the total droplet amount also fluctuates. In this case, the increment in the total droplet amount is 1.1 pl at the maximum. That is, the total droplet amount is 42 pl±0.55 pl. In other words, the total droplet amount is 42 pl±1.3%.

As compared with the comparative example, in this embodiment using the inkjet head A 104 and the inkjet head B 105 which are different from each other in the volume per one drop, the variation of the total droplet amount for all pixels in the arrangement direction of the nozzles 1041 and the nozzles 1051 can be suppressed.

In view of the variation of the volume per one drop from the inkjet head A 104 and the inkjet head B 105, the control unit 101 corrects the number of drops from the inkjet head A 104 and the inkjet head B 105. Here, one specific nozzle 1041 of the plural nozzles 1041 arranged in the inkjet head A 104 and one specific nozzle 1051 of the plural nozzles 1051 arranged in the inkjet head B 105 eject ink to one specific pixel.

Accordingly, the control unit 101 corrects the number of drops with respect to the combinations of the nozzles 1041 of the inkjet head A 104 to eject ink and the nozzles 1051 of the inkjet head B 105 for all pixels in the arrangement direction of the nozzles 1041 and the nozzles 1051. The correction of the number of drops from the inkjet head A 104 and the inkjet head B 105 will be described later.

FIG. 4 is a table of another example showing a relation between the number of drops from the inkjet head A 104 and the inkjet head B 105 and the total droplet amount for one pixel. Here, a volume per one drop of ink ejected from each of the nozzles 1041 arranged in the inkjet head A 104 of this embodiment is made to 6.25 pl on average. A volume per one drop of ink ejected from each of the nozzles 1051 arranged in the inkjet head B 105 is made to 5.75 pl on average.

As shown in FIG. 4, in this embodiment, the combination of the number of drops from the inkjet head A 104 and the inkjet head B 105, which are different from each other in the volume per one drop, is changed. Similarly to the fact that the volume difference per one drop between the inkjet head A 104 and the inkjet head B 105 is 0.5 pl, the total droplet amount for one specific pixel is also changed in increments of 0.5 pl.

As compared with the example shown in FIG. 3, in the example shown in FIG. 4, the adjustment range of the total droplet amount for one pixel is small. That is, in the example shown in FIG. 4, the error of the total droplet amount required for each pixel can be made small.

As stated above, the volume difference per one drop between the inkjet head A 104 and the inkjet head B 105 can be changed according to the variation amount of volume per one drop between the nozzles 1041 and the nozzles 1051 and the accuracy of the total droplet amount required for each pixel.

Here, although the example is described in which the two of the inkjet head A 104 and the inkjet head B 105 are used, no limitation is made to this. For example, one inkjet head having two nozzle lines in a direction orthogonal to a conveyance direction of a recording medium may be used. In this case, the inkjet head ejects ink to one pixel by two nozzles opposite to each other in the conveyance direction of the recording medium. The nozzle lines are different from each other in volume per one drop.

Further, one inkjet head having one nozzle line in a direction orthogonal a conveyance direction of a recording medium may be used. In this case, the inkjet head ejects ink to one pixel from two adjacent nozzles. The two nozzles are different from each other in volume per one drop. In addition to the case where ink is ejected to one pixel from two nozzles as stated above, ink may be ejected to one pixel from three or more nozzles.

As an example of a method of making a volume per one drop from the inkjet head A 104 different from a volume per one drop from the inkjet head B 105, a following case will be described. For example, there is a case where drive voltage of the inkjet head A 104 is different from that of the inkjet head B 105. There is a case where the shape, such as a nozzle diameter, of the inkjet head A 104 is different from that of the inkjet head B 105. There is a case where drive waveform of the inkjet head A 104 is different from that of the inkjet head B 105. The case where the drive voltage is different is preferable since this can deal with a case where the inkjet head A 104 and the inkjet head B104 are not used for ejection of ink unlike this embodiment.

When one inkjet head having one nozzle line in the direction orthogonal to the conveyance direction of the recording medium is used, a single nozzle may eject inks of different volumes to one pixel. In this case, the single nozzle can have a difference in volume per one drop by different drive waveforms. The single nozzle may be controlled by different drive voltages for respective pixels. In the single nozzle, when timing of ejection of ink is separated, inks of different volumes for one drop can be ejected by merely periodically changing power source voltage.

The volume per one drop from the inkjet head A 104 and the inkjet head B 105 may be previously determined at a design stage or may be arbitrarily changed by the user through the keyboard 109.

Figure 5:
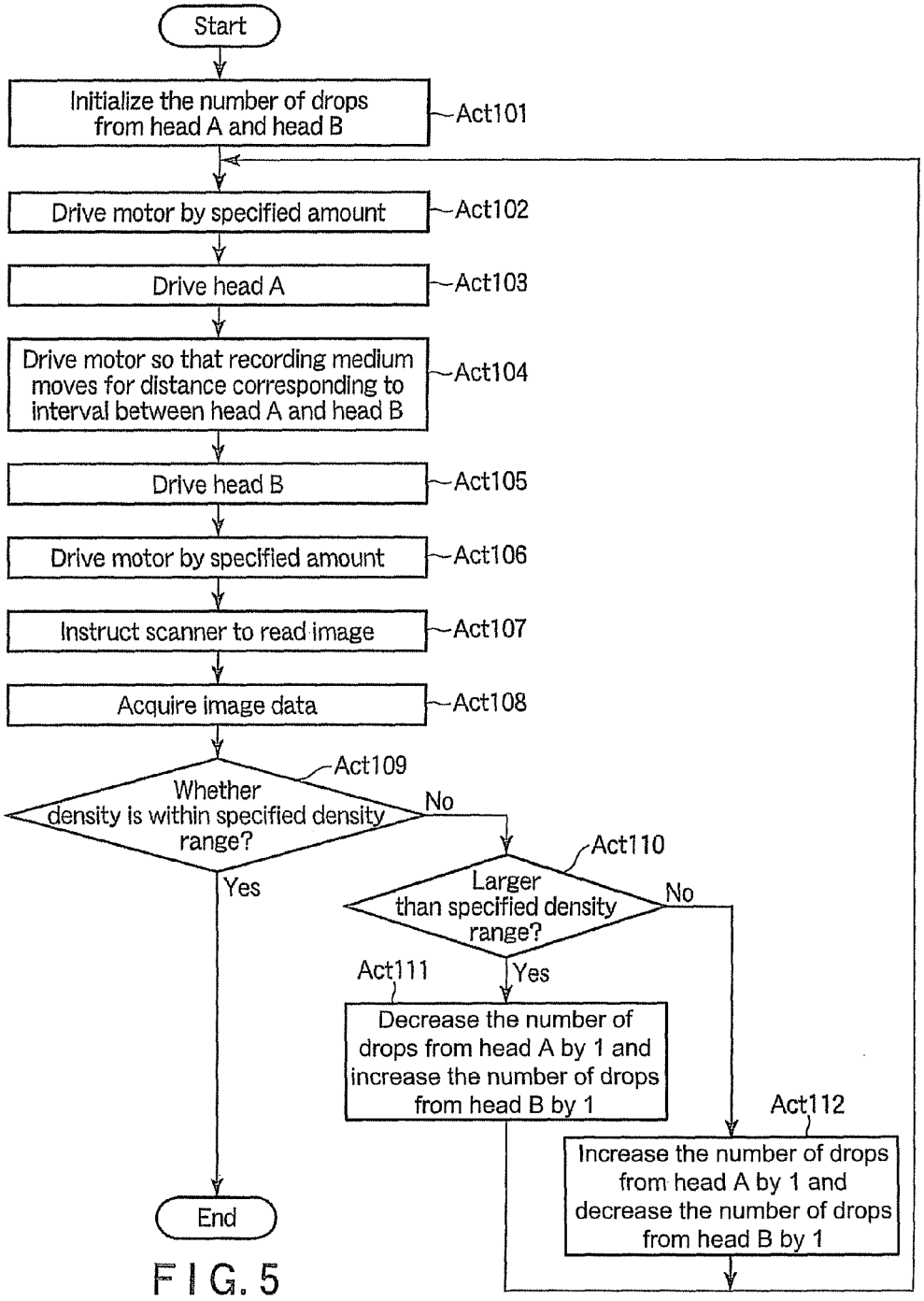
FIG. 5 is a flowchart for explaining correction of the number of drops from the inkjet head A and the inkjet head B of the embodiment.

Next, correction of the number of drops from the inkjet head A 104 and the inkjet head B 105 will be described with reference to a flowchart shown in FIG. 5. For example, when the user inputs initial setting of the inkjet head A 104 and the inkjet head B 105 through the keyboard 109, the control unit 101 executes the flow shown in FIG. 5. This flow is for a case where the volume per one drop from the inkjet head A 104 is larger than the volume per one drop from the inkjet head B 105. The same applies to the opposite case.

First, the control unit 101 initializes the number of drops from the inkjet head A 104 and the inkjet head B 105 (Act 101).

For example, with respect to one specific pixel, the initial values are set such that the number of drops from the inkjet head A 104 is 4 and the number of drops from the inkjet head B 105 is 3, which are indicated in the example of FIG. 3.

The control unit 101 drives the motor 107 through the motor drive control circuit 106 by a specified amount (Act 102). The recording medium is conveyed according to driving of the motor 107 to a position where it faces the inkjet head A 104.

The control unit 101 drives the inkjet head A 104 through the head drive control circuit 103 (Act 103). The inkjet head A 104 ejects drops, the number of which corresponds to image data, for each line in the arrangement direction of the nozzles 1041 from each of the nozzles 1041.

The control unit 101 drives the motor 107 by a specified amount through the motor drive control circuit 106 so as to convey the recording medium for each line portion to a position where it faces the inkjet head B 105 (Act 104).

The control unit 101 drives the inkjet head B 105 through the head drive control circuit 103 (Act 105). The inkjet head B 105 ejects drops, the number of which corresponds to the image data, for each line in the arrangement direction of the nozzles 1051 from each of the nozzles 1051.

When the inkjet head B 105 ends the image formation on the recording medium based on the image data, the control unit 101 drives the motor 107 by a specified amount through the motor drive control circuit 106 (Act 106). The control unit 101 drives the motor 107 through the motor drive control circuit 106 by the specified amount so as to convey the recording medium to the scanner 111.

The control unit 101 instructs the scanner 111 to read an image of the recording medium through the scanner drive control circuit 110 (Act 107). The scanner 111 reads the image of the recording medium (Act 108). The control unit 101 determines whether the density of each pixel in the image of the recording medium is within a specified range (Act 109). This is because there is a correlation between the droplet amount for one pixel and the density of one pixel.

When the density of one arbitrary pixel is within the specified range (Act 109, YES), the control unit 101 ends the correction flow of the number of drops from the inkjet head A 104 and the inkjet head B 105 for the one arbitrary pixel.

When the density of the one arbitrary pixel is not within the specified range (Act 109, NO), the control unit 101 determines whether or not the density of the one arbitrary pixel is higher than the specified density range (Act 110). When the density of the one arbitrary pixel is higher than the specified density range (Act 110, YES), the control unit 101 decreases the number of drops from the inkjet head A 104 by one, and increases the number of drops from the inkjet head B 105 by one (Act 111). In the case of the example shown in FIG. 3, the control unit 101 corrects the number of drops from the inkjet head A 104 from the initial value of 4 to 3, and corrects the number of drops from the inkjet head B 105 from the initial value of 3 to 4. Thereafter, the control unit 101 returns to Act 102 and repeats the operation.

When the density of the one arbitrary pixel is not higher than the specified density range (that is, when the density of the one arbitrary pixel is lower than the specified density range) (Act 110, NO), the control unit 101 increases the number of drops from the inkjet head A 104 by one, and decreases the number of drops from the inkjet head B 105 by one (Act 112). In the case of the example shown in FIG. 3, the control unit 101 corrects the number of drops from the inkjet head A 104 from the initial value of 4 to 5, and corrects the number of drops from the inkjet head B 105 from the initial value of 3 to 2. Thereafter, the control unit 101 returns to Act 102 and repeats the operation.

The nozzle 1041 and the nozzle 1051 of the inkjet head A 104 and the inkjet head B 105 opposite to each other in the conveyance direction of the recording medium are paired, and the control unit 101 executes the operation on all pairs of the nozzles 1041 and the nozzles 1051 in the arrangement direction. The control unit 101 records the relation between the total droplet amount for one pixel and the number of drops from the inkjet head A 104 and the inkjet head B 105, which are set based on this flow, into the recording unit 102.

According to this embodiment, the total droplet amount per one pixel can be easily controlled by the combination of the numbers of drops from the multi-drop driving inkjet head A 104 and inkjet head B 105.

At Act 106 and Act 107, although the control unit 101 conveys the recording medium subjected to image formation to the scanner 111 and controls the read operation of the scanner 111, no limitation is made to this. For example, the user once takes out the recording medium which is subjected to the image formation by the operation up to Act 104, and may cause the scanner 111 to read it. In this case, the operation subsequent to Act 108 is the same.

Figure 6:
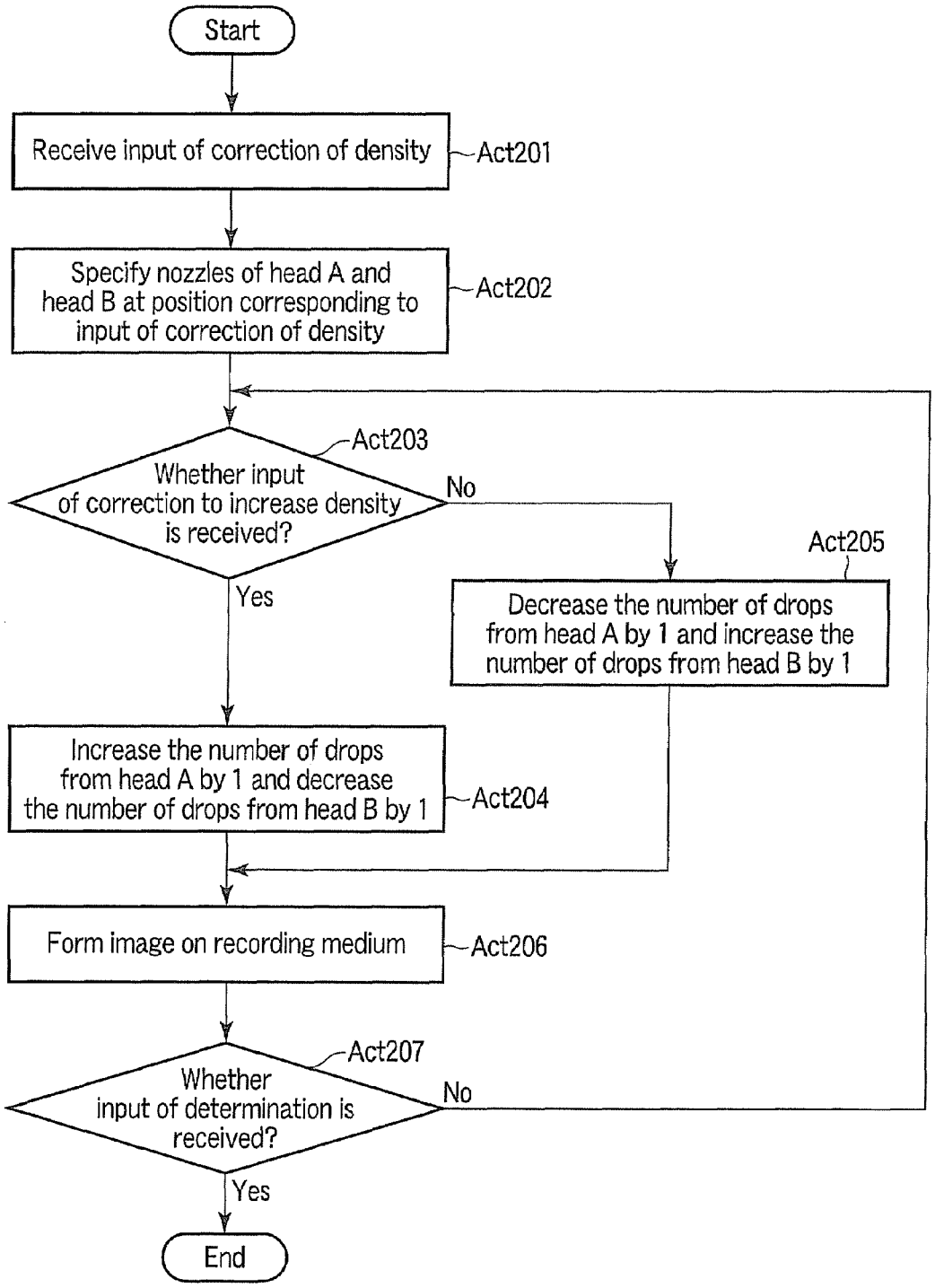
FIG. 6 is a flowchart for explaining correction of the number of drops from the inkjet head A and the inkjet head B of the embodiment.

Next, the correction of the numbers of drops from the inkjet head A 104 and the inkjet head B 105 will be described with reference to a flowchart shown in FIG. 6. The user looks at the recording medium subjected to the image formation and can determine a level of image density. Accordingly, when the user inputs the correction of the image density by the keyboard 109, the control unit 101 corrects the numbers of drops from the inkjet head A 104 and the inkjet head B 105 in accordance with the flow shown in FIG. 6. This flow is for the case where the volume per one drop from the inkjet head A 104 is larger than the volume per one drop from the inkjet head B 105. The same applies to the opposite case.

First, the user uses the keyboard 109 to input an area, whose density is desired to be corrected, of the recording medium subjected to the image formation. The control unit 101 receives the input of correction of the image density from the keyboard 109 through the keyboard control circuit 108 (Act 201). Next, the control unit 101 specifies the nozzle 1041 of the inkjet head A 104 and the nozzle 1051 of the inkjet head B 105 to eject ink to a pixel constituting the area for which the correction of the image density is inputted (Act 202).

The control unit 101 determines whether the correction to increase (become thick) the image density of the pixel as the object of the correction of the image density is inputted (Act 203). When the correction to increase the image density is inputted (Act 203, YES), the control unit 101 increases, by one, the number of drops from the nozzle 1041 of the inkjet head A 104 corresponding to the pixel for which the correction of the image density is inputted, and decreases the number of drops from the nozzle 1051 of the inkjet head B 105 by one (Act 204).

When the correction to increase the image density is not inputted (that is, correction to decrease (become thin) the image density is inputted) (Act 203, NO), the control unit 101 decreases, by one, the number of drops from the nozzle 1041 of the inkjet head A 104 corresponding to the pixel for which the correction of the image density is inputted, and increases the number of drops from the nozzle 1051 of the inkjet head B 105 by one (Act 205).

After correcting the numbers of drops from the inkjet head A 104 and the inkjet head B 105, the control unit 101 performs image formation on the recording medium by the inkjet head A 104, the inkjet head B 105 and the motor 107 (Act 206).

The user looks at the recording medium subjected to the image formation and can determine a level of image density. When the user desires to end the correction of the image density, the user inputs the end of the correction of the image density by the keyboard 109. When the user further desires to correct the image density, the user uses the keyboard 109 to input an area, whose density is desired to be corrected, of the recording medium subjected to the image formation.

The control unit 101 determines whether the input of the end of the correction of the image density is received (Act 207). When the control unit 101 receives the input of the end of the correction of the image density (Act 207, YES), the control unit 101 ends the correction flow of the numbers of drops from the inkjet head A 104 and the inkjet head B 105. When the control unit 101 does not receive the input of the end of the correction of the image density (that is, when the input of the correction of the image density is further made) (Act 207, YES), the control unit 101 returns to Act 203 and repeats the operation. The control unit 101 executes the flow on all pixels constituting the area for which the correction of the image density is inputted. The control unit 101 records the relation between the total droplet amount for one pixel and the numbers of drops from the inkjet head A 104 and the inkjet head B 105, which are set based on this flow, into the recording unit 102.

According to this embodiment, the droplet amount ejected for each pixel of one line printed on the recording medium can be made close to a required amount. Further, according to this embodiment, the density for each pixel of one line printed on the recording medium can be easily changed according to the desire of the user.

What is claimed is:

1. A density correction system comprising:

a conveyance unit that conveys a recording medium;

a first ink ejection unit that ejects ink in a multi-drop driving system to the recording medium based on image data;

a second ink ejection unit that ejects ink in the multi-drop driving system to the recording medium based on the image data and in which a volume per one drop is smaller than a volume per one drop of the first ink ejection unit; and a control unit that corrects a number of drops from the first ink ejection unit and a number of drops from the second ink ejection unit, which constitute a droplet amount for one pixel on the recording medium subjected to image formation, wherein the control unit keeps constant the sum of the numbers of drops from one nozzle of the first ink ejection unit and one nozzle of the second ink ejection unit, which corresponds to one arbitrary pixel.

2. The system of claim 1, wherein the control unit determines whether image density of one arbitrary pixel is within a specified density range, and when the image density is not within the specified density range, the control unit corrects the number of drops from the first ink ejection unit and the number of drops from the second ink ejection unit.

3. The system of claim 2, wherein the control unit reads the image density of the one arbitrary pixel from the recording medium subjected to the image formation, and determines whether the image density is within the specified density range.

4. The system of claim 3, wherein when the control unit determines that the image density of the one arbitrary pixel is higher than the specified density range, the control unit decreases the number of drops from the first ink ejection unit by one and increases the number of drops from the second ink ejection unit by one.

5. The system of claim 3, wherein when the control unit determines that the image density of the one arbitrary pixel is lower than the specified density range, the control unit increases the number of drops from the first ink ejection unit by one and decreases the number of drops from the second ink ejection unit by one.

6. The system of claim 1, wherein the first ink ejection unit has a first nozzle line in a direction orthogonal to a conveyance direction of the recording medium, and the second ink ejection unit has a second nozzle line in the direction orthogonal to the conveyance direction of the recording medium.

7. The system of claim 6, wherein the control unit pairs a nozzle in the first nozzle line with a nozzle in the second nozzle line, which are opposite to each other in the conveyance direction of the recording medium, and corrects the number of drops.

8. The system of claim 7, comprising an input unit to input correction of image density of the recording medium subjected to the image formation.

9. The system of claim 8, wherein the control unit specifies, based on the input of the correction of the image density from the input unit, a pair of nozzles for which the number of drops from the first ink ejection unit and the number of drops from the second ink ejection unit are corrected.

10. The system of claim 9, wherein when the image density is corrected to become thick, the control unit increases the number of drops from the first ink ejection unit by one and decreases the number of drops from the second ink ejection unit by one.

11. The system of claim 9, wherein when the image density is corrected to become thin, the control unit decreases the number of drops from the first ink ejection unit by one and increases the number of drops from the second ink ejection unit by one.

12. A density correction method used for a system including a conveyance unit that conveys a recording medium, a first ink ejection unit of a multi-drop driving system, and a second ink ejection unit of the multi-drop driving system, in which a volume per one drop is smaller than a volume per one drop of the first ink ejection unit, the method comprising:

ejecting ink from the first ink ejection unit and the second ink ejection unit to the recording medium based on image data;

correcting number of drops ejected from the first ink ejection unit and number of drops ejected from the second ink ejection unit, which constitute a droplet amount for one pixel on the recording medium subjected to image formation; and keeping constant the sum of the number of drops from the first ink ejection unit and the number of drops from the second ink ejection unit with respect to one arbitrary pixel.

13. The method of claim 12, comprising:

determining whether image density of one arbitrary pixel is within a specified density range; and correcting, when the image density is not within the specified density range, the number of drops from the first ink ejection unit and the number of drops from the second ink ejection unit.

14. The method of claim 13, comprising:

reading the image density of the one arbitrary pixel from the recording medium subjected to the image formation, and determining whether the image density is within the specified density range.

15. The method of claim 14, comprising:

decreasing, when it is determined that the image density of the one arbitrary pixel is higher than the specified density range, the number of drops from the first ink ejection unit by one and increasing the number of drops from the second ink ejection unit by one.

16. The method of claim 14, wherein increasing, when it is determined that the image density of the one arbitrary pixel is lower than the specified density range, the number of drops from the first ink ejection unit by one and decreasing the number of drops from the second ink ejection unit by one.

17. The method of claim 12, comprising:

pairing a nozzle in a first nozzle line provided in the first ink ejection unit with a nozzle in a second nozzle line provided in the second ink ejection unit, which are opposite to each other in a conveyance direction of the recording medium; and correcting the number of drops.

* * * * *